US005330127A

United States Patent [19]

Häfner

[11] Patent Number: 5,330,127

[45] Date of Patent: Jul. 19, 1994

[54] WINDING SPOOL FOR RIBBONLIKE OR FILAMENTARY MATERIAL

[75] Inventor: Manfred Häfner, Leopoldshöhe, Fed. Rep. of Germany

[73] Assignee: Häfner & Krullmann GmbH, Leopoldshöhe, Fed. Rep. of Germany

[21] Appl. No.: 11,650

[22] Filed: Jan. 28, 1993

[30] Foreign Application Priority Data

Jan. 31, 1992 [DE] Fed. Rep. of Germany ... 9201120[U]

[51] Int. Cl.[5] ..... B65H 75/14

[52] U.S. Cl. ..... 242/118.4; 242/118.7

[58] Field of Search ..... 242/118.4, 118.6, 118.7, 242/118.8, 77, 77.3

[56] References Cited

U.S. PATENT DOCUMENTS

| | | | |
|---|---|---|---|
| 1,520,379 | 12/1924 | Wermine | 242/118.4 |
| 1,981,809 | 11/1934 | Mueller | 242/118.8 |
| 2,212,377 | 8/1940 | Olson et al. | 242/118.8 |
| 2,286,640 | 6/1942 | Olson et al. | 242/118.8 |
| 2,601,660 | 6/1952 | Jarmicki . | |
| 2,687,261 | 8/1954 | Jarmicki . | |
| 3,468,495 | 9/1969 | Starratt . | |
| 4,607,806 | 8/1986 | Yealy . | |
| 4,997,142 | 3/1991 | Grant | 242/118.4 |

FOREIGN PATENT DOCUMENTS

| | | |
|---|---|---|
| 3823334 | 3/1989 | Fed. Rep. of Germany . |
| 717617 | 10/1954 | United Kingdom . |
| 932863 | 7/1963 | United Kingdom . |

*Primary Examiner*—Stanley N. Gilreath
*Attorney, Agent, or Firm*—Feiereisen & Kueffne

[57] ABSTRACT

A winding spool for ribbonlike or filamentary winding material includes a cylindrical mandrel which is provided at each axial end with a disk-like rim. Arranged concentrically inside the mandrel is a tubular inner hub which is connected in one piece with the mandrel at one axial end thereof. The other axial end of the mandrel is closed by a cover which is provided with a central bore for attachment of a mandrel drive shaft of a winding machine. An inner tubular member with smooth inside surface is fixedly secured to the cover in elongation of the central bore and to the inner hub for improving integrity of the winding spool when being subjected to extreme loads during winding or unwinding of the material.

14 Claims, 2 Drawing Sheets

WINDING SPOOL FOR RIBBONLIKE OR FILAMENTARY MATERIAL

BACKGROUND OF THE INVENTION

The present invention refers to a winding spool for ribbonlike or filamentary material, and in particular to a winding spool of the type having a cylindrical mandrel provided at each axial end with a disk-like rim, an inner hub arranged concentrically to the center axis of the mandrel and connected to one axial end of the mandrel, and a cover secured to the other axial end of the mandrel in opposition of the inner hub.

A winding spool of this type is attached and secured to a mandrel drive shaft of a winding machine and driven at extremely high speed during winding of the material. Generally, the winding spool is attached to the mandrel drive shaft from the axial end where the cover is located, with the drive shaft only covering part of the entire width of the spool. The inner hub is of relatively short length in relation to the width of the spool so that the drive shaft will not engage the inner hub. Forces exerted during winding of material are therefor transmitted to and received solely by the cover which is thus subjected to significant stress. This excessive stress may cause a detachment of the cover from the cylindrical mandrel of the spool, leading to a loosening of the spool from the drive shaft. Eventually, the spool moves away from the shaft in an uncontrolled manner, subjecting the user to great danger.

SUMMARY OF THE INVENTION

It is an object of the present invention to provide an improved winding spool obviating the afore-stated drawbacks.

In particular, it is an object of the present invention to provide an improved winding spool by which a high safety standard is accomplished even when the mandrel drive shaft of the winding machine engages the spool over only part thereof.

These objects and others which will become apparent hereinafter are attained in accordance with the present invention by providing the spool with an inner tubular member which has a smooth inside surface and is fixedly secured to the cover and the inner hub.

Suitably, the inner tubular member is oriented concentrically to the center axis or rotational axis of the winding spool.

The mandrel is generally of reduced elongation with respect to the overall width of the spool and is provided with a short stub which prolongs the mandrel beyond the branching-off point of the cover-near rim and is in alignment with the mandrel which extends between the opposing rims. The stub is welded, e.g. through ultrasonic welding, to the facing edge of the cover. Thus, even in case the weld between the edge of the cover and the stub of the mandrel is destroyed, the spool is still prevented from disengaging from the drive shaft because the inner tubular member remains securely fixed to the stub of the mandrel.

In order to improve the connection between the cover and the mandrel, it is preferred to substitute the conventional butt joint by a lap joint in which the stub-facing edge of the cover overlaps the stub, or by a respectively designed tongue and groove joint.

The mandrel drive shaft is equipped with clamping elements for fixedly retaining the spool. Preferably, the inner tubular member is finished with a smooth inside surface so that no welding joints are encountered which may interfere or complicate the clamping action or otherwise hit the sensitive drive shaft.

According to another feature of the present invention, the cover and the inner tubular member are formed as a one-piece molded part of plastic material in order to further simplify the construction of the spool and to further increase the safety aspect of the spool as the presence of another welding seam is eliminated. Suitably, also the mandrel with its rims is made of plastic material. The inner tubular member may be fixedly secured to the inner hub through an adhesive joint or through solvent welding, with the adhesive or the solvent being applied over the entire interface between the inner tubular member and the inner hub, or spotwise.

In accordance with one embodiment of the present invention, the inner tubular member extends from one axial end of the spool to the other axial end thereof. However, spools are known which include at least at one axial end thereof a recess in form of a truncated cone. In this case, the inner tubular member extends from the other axial end of the spool to the truncated cone-shaped recess or, in the event both axial ends are provided with such a recess, across the area between these opposing recesses.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
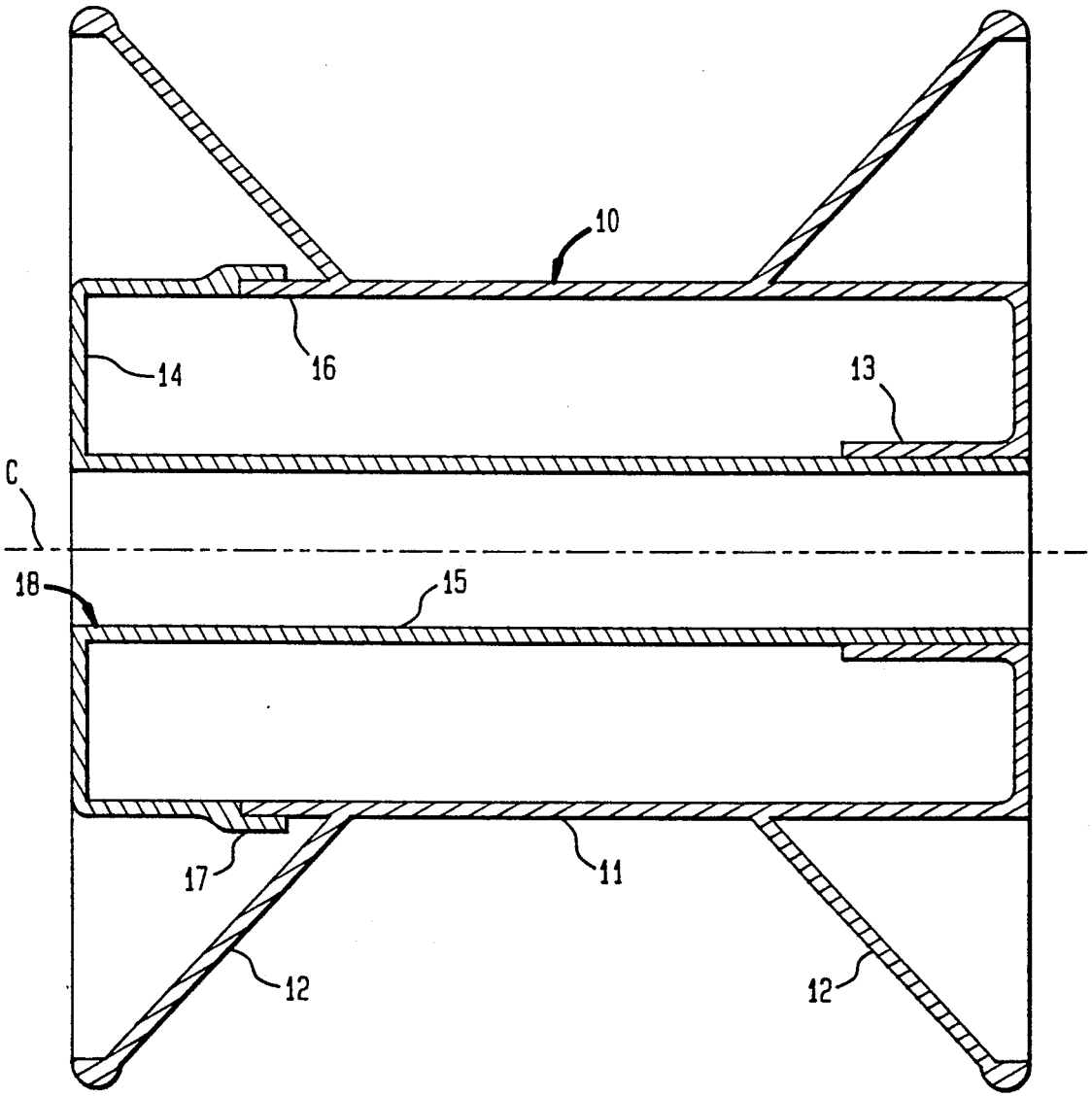
FIG. 1 is a sectional view of a first embodiment of a winding spool according to the present invention.

Throughout all the FIGURES, the same or corresponding elements are always indicated by the same reference numerals.

Referring now to the drawing and in particular to FIG. 1, there is shown a sectional view of one embodiment of a winding spool according to the present invention, generally designated by reference numeral 10. The spool 10 includes a generally cylindrical mandrel or barrel 11 which is defined by a center axis C. At each axial end thereof, the mandrel 11 is integrally connected with two opposing disk-like rims 12 which branch off slantingly relative to the center axis C of the spool 10, with the angle of inclination of each rim 12 being preferably about 45°. In the nonlimiting example of FIG. 1, the rims 12 extend away from each other so as to have a diverging configuration relative to the center axis C.

At one axial end (in FIG. 1, the axial end at the right hand side), the mandrel 11 is integrally connected to a tubular hub or bushing 13 which runs concentrically to the center axis C and extends inwardly from the axial end in direction towards the opposing axial end of the winding spool 10. The length of the hub 13 is relatively short compared to the overall width of the winding spool 10, and may amount to only about 1/5th of the width of the spool 10.

As shown in FIG. 1, the mandrel 11 does not extend over the entire width of the winding spool 10 but is merely extended beyond the branching off point of the respective rim 12 by a short tubular stub 16 which is in alignment with the mandrel 11. The stub 16 is connected to a cover 14 which closes off the other axial end of the spool 10 and is provided with a central bore 18 for allowing attachment of a mandrel drive shaft (not shown) of a winding machine (not shown). At its end facing the stub 16 of the mandrel 11, the cover 14 is provided with an offset finger-like projection 17 which overlaps the stub 16 of the mandrel 11 and is welded thereto via a lap joint to securely fix the mandrel 11 with the cover 14.

Extending concentrically inside the mandrel 11 is a tubular member 15 which is connected at one axial end with the cover 14 and extends along the entire width of the winding spool 10 to the other axial end thereof. Suitably, the cover 14 and the inner tubular member 15 are formed as a one-piece molded part of plastic material. The other axial end of the inner tubular member 15 is enclosed by the inner hub 13 and securely fixed thereto via an adhesive joint or through solvent welding, with the adhesive or solvent either applied over the entire interface between the hub 13 and the inner tubular member 15, or applied only spotwise. Persons skilled in the art will understand that other welding processes such as friction welding may certainly also be employed for securely connecting the hub 13 to the tubular member 15 without departing from the spirit of the present invention.

The inner tubular member 15 is preferably provided with a smooth inside surface of superior surface finish in order to ensure clamping elements of the mandrel drive shaft to snugly fit the inner tubular member 15 and to securely receive the spool 10.

By connecting the hub 13 with the cover 14 via the tubular member 15, the winding spool 10 is prevented from an axial displacement and a detachment from the winding machine even when the weld between the cover 14 and the cylindrical mandrel 11 is destroyed.

In the non-limiting example of the winding spool of FIG. 1, the inner tubular member 15 extends over the entire width of the spool 10, i.e. from one axial end of the spool 10 to the other axial end thereof. However, spools 10 are known which are provided at one or both axial ends with a truncated cone-shaped recess, as is shown by way of example in FIGS. 2 and 3 which are sectional views of two additional embodiments of a winding spool according to the invention.

Figure 2:
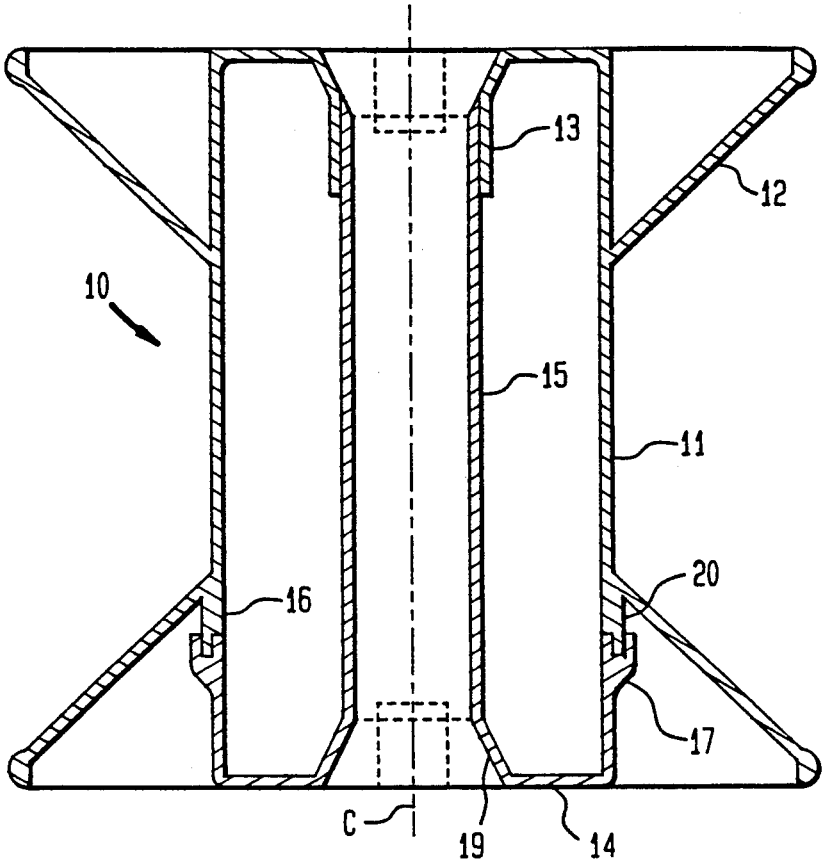
FIG. 2 is a sectional view of a second embodiment of a winding spool according to the present invention.

In FIG. 2, the winding spool 10, which is of similar type as the winding spool shown in FIG. 1, is provided at each axial end with a recess 19 of truncated cone shape, with the inner tubular member 15 extending between both recesses 19. Even though not shown in detail in the drawing, in case the winding spool 10 is provided with only one such recess 19 at one axial end thereof, the tubular member 15 extends from the truncated cone-shaped recess to the opposing axial end.

The cover 14 is connected to the stub 16 via a tongue and groove joint, with the stub 16 being provided with a tongue 20 and the cover 14 having a bifurcated axial end 17 with a groove for engagement by the tongue 20.

Figure 3:
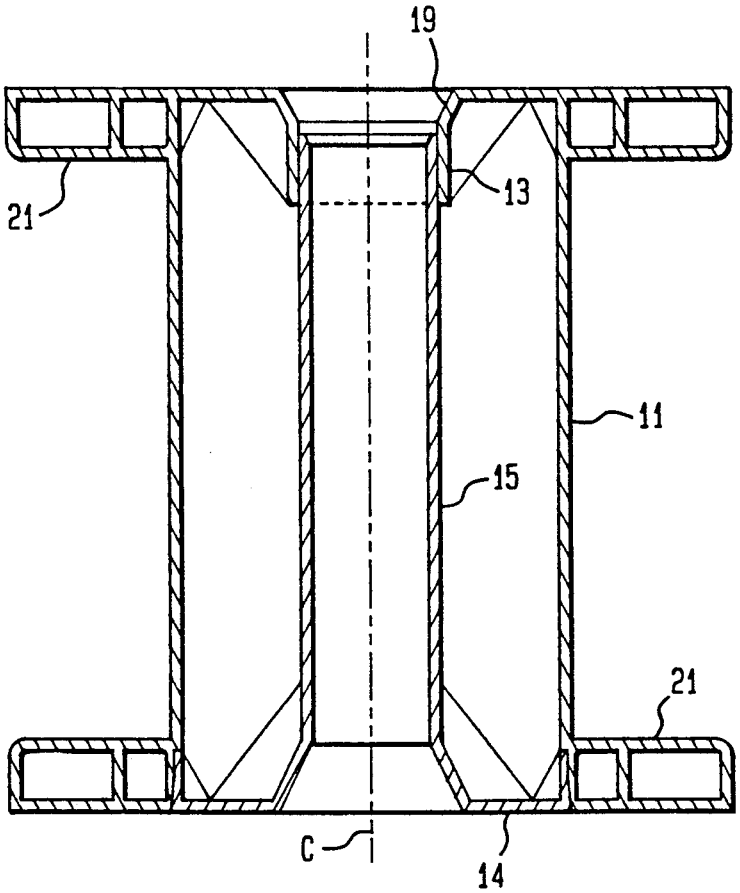
FIG. 3 is a sectional view of a third embodiment of a winding spool according to the present invention.

FIG. 3 shows a further embodiment of a winding spool 10 which is of H-shaped configuration, with the mandrel 11 being provided in one piece at the opposing axial ends with disk-shaped end flanges 21 which extend perpendicular to the center axis C. At each axial end, the spool 10 includes a recess 19 of truncated cone shape, with the inner tubular member 15 extending between both recesses 19. The connection between the cover 14 and the mandrel 11 is made via a suitable lap joint.

For manufacturing purposes, the securement of the cover 14 in one piece with the inner tubular member 15 is advantageous since the larger part, comprised of mandrel 11 and rims 12, can be made on a respectively bigger machine without decrease of performance while the smaller part, comprised of cover 14 and inner tubular member 15, may be made on a smaller machine. The configuration as a one-piece molded part of cover 14 and tubular member 15 reduces the performance which however affects only the smaller machine.

While the invention has been illustrated and described as embodied in a winding spool for ribbonlike or filamentary material, it is not intended to be limited to the details shown since various modifications and structural changes may be made without departing in any way from the spirit of the present invention.

What is claimed as new and desired to be protected by Letters Patent is set forth in the appended claims:

1. A winding spool for ribbonlike or filamentary winding material; comprising:

a cylindrical mandrel defining an axis and being provided at each axial end with a disk-like rim;

a tubular inner hub arranged concentrically to said axis and connected at one axial end of said mandrel;

a cover secured to the other axial end of said mandrel in opposition to said hub; and an inner tubular member with smooth inside surface and fixedly secured to said cover and said inner hub, wherein said mandrel is extended beyond said cover-near rim by a stub, said cover including an edge overlapping said stub of said mandrel.

2. A winding spool as defined in claim 1 wherein said inner tubular member extends from one axial end to the other axial end of the spool.

3. A winding spool as defined in claim 1, with the spool having at least one truncated cone-shaped recess extending concentric to said axis at one axial end thereof, said inner tubular member extending from said recess in direction of said other axial end of the spool.

4. A winding spool as defined in claim 1, with the spool having a truncated cone-shaped recess extending concentric to said axis at each axial end thereof, said inner tubular member extending between said opposing recesses.

5. A winding spool as defined in claim 1 wherein said cover and said inner tubular member are formed by a one-piece molded part of plastic material.

6. A winding spool as defined in claim 1 wherein said cover and said mandrel are connected together through welding.

7. A winding spool as defined in claim 1 wherein said inner hub and said inner tubular member are connected together through an adhesive joint.

8. A winding spool as defined in claim 7 wherein said adhesive joint covers the entire area of the interface between said inner hub and said inner tubular member.

9. A winding spool as defined in claim 7 wherein said adhesive joint is applied spotwise over the interface between said inner hub and said inner tubular member.

10. A winding spool as defined in claim 1 wherein said inner hub is secured to said inner tubular member through solvent welding.

11. A winding spool as defined in claim 10 wherein the entire area of the interface between said inner hub and said inner tubular member is connected through solvent welding.

12. A winding spool as defined in claim 10 wherein the interface between said inner hub and said inner tubular member is connected spotwise through solvent welding.

13. A winding spool as defined in claim 1 wherein said edge of said cover and said stub are connected together by a lap joint.

14. A winding spool as defined in claim 1 wherein said edge of said cover and said stub are connected together by a tongue and groove joint.

* * * * *